US011591864B2

(12) United States Patent
Al-Ghamdi

(10) Patent No.: US 11,591,864 B2
(45) Date of Patent: Feb. 28, 2023

(54) RUNNING AND RETRIEVING TUBING IN A WELLBORE

(71) Applicant: Saudi Arabian Oil Company, Dhahran (SA)

(72) Inventor: Bakr Abdulrahim Al-Ghamdi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/230,329

(22) Filed: Apr. 14, 2021

(65) Prior Publication Data

US 2022/0333450 A1 Oct. 20, 2022

(51) Int. Cl.

| | |
|---|---|
| ***E21B 19/16*** | (2006.01) |
| ***E21B 17/042*** | (2006.01) |
| ***E21B 19/07*** | (2006.01) |

(52) U.S. Cl.

CPC ..... *E21B 19/161* (2013.01); *E21B 17/042* (2013.01); *E21B 19/07* (2013.01)

(58) Field of Classification Search

CPC ..... E21B 19/161; E21B 17/042; E21B 19/07
See application file for complete search history.

(56) References Cited

U.S. PATENT DOCUMENTS

| | | | | |
|---|---|---|---|---|
| 6,263,763 | B1 | 7/2001 | Feigel et al. | |
| 9,441,427 | B2 | 9/2016 | Pilgrim | |
| 2007/0074606 | A1* | 4/2007 | Halse | E21B 19/164 81/57.16 |
| 2014/0124218 | A1* | 5/2014 | Pilgrim | E21B 19/161 166/380 |
| 2014/0216817 | A1* | 8/2014 | Vatne | E21B 19/10 175/57 |

FOREIGN PATENT DOCUMENTS

WO WO 2009091265 7/2009

OTHER PUBLICATIONS weatherford.com [online], "Handling Equipment," Weatherford International, available on or before Jul. 6, 2019 via Internet Archive: Wayback Machine <https://web.archive.org/web/20190706114342/https://www.weatherford.com/en/products-and-services/tubular-running-services/traditional-systems/conventional/handling-equipment/>, retrieved on Apr. 7, 2021, retrieved from URL <https://www.weatherford.com/en/products-and-services/tubular-running-services/traditional-systems/conventional/handling-equipment/>, 9 pages.

(Continued)

*Primary Examiner* — Taras P Bemko
(74) *Attorney, Agent, or Firm* — Fish & Richardson P.C.

(57) ABSTRACT

A wellbore surface assembly includes a slip assembly, vertical rails, linear actuators, and an iron roughneck. The slip assembly is attached to a floor surface of a wellbore and it includes movable slips that engage a first tube. The vertical rails are attached to the base of the automatic slip assembly. The iron roughneck is movable along the vertical rails. The automatic iron roughneck includes a frame, a rotary ring, die actuators, and dies. The iron roughneck is movable by the linear actuators along a length of the vertical rails, changing an elevation of the iron roughneck with respect to the automatic slip assembly and the floor surface of the wellbore. The dies engage the second tube and the rotary ring rotates the second tube, threadedly attaching or detaching the second tube from the first tube.

20 Claims, 4 Drawing Sheets

(56) References Cited

OTHER PUBLICATIONS weatherford.com [online], "Weatherford's UniTong All-in-one tong system," Weatherford, 2010, 4 pages.
Youtube.com [online], "UniSlips, Weatherford," Mar. 20, 2014, retrieved on May 6, 2021, retrieved from URL <https://www.youtube.com/watch?v=jHV7TSWIsvo>, 1 page.

* cited by examiner

RUNNING AND RETRIEVING TUBING IN A WELLBORE

FIELD OF THE DISCLOSURE

This disclosure relates to wellbores, in particular, to tubular handling tools.

BACKGROUND OF THE DISCLOSURE

Wellbores are drilled into the earth for production or other purposes. Wellbores receive tubular strings such as casing strings and drill strings. Tubular strings include multiple connected pipe sections or tubulars joined end to end. For example, a drill string is run into the wellbore by connecting multiple drill pipe sections at the surface of the wellbore until reaching a desired length of the drill string. The drill string or part of the drill string is pulled out of the wellbore by retrieving and disconnecting tubular sections one by one at the surface of the wellbore. Methods and equipment for improving the process of running and pulling out tubulars to and from a wellbore are sought.

SUMMARY

Implementations of the present disclosure include a wellbore surface assembly that includes an automatic slip assembly, two or more vertical rails, two or more linear actuators, and an automatic iron roughneck. The automatic slip assembly is attached to a floor surface of a wellbore. The automatic slip assembly includes a base, two or more slip actuators, and two or more slips disposed within a hole of the base. Each of the two or more slips are movable by a respective one of the two or more slip actuators toward a center of the hole of the base, engaging a first tube disposed within the hole such that the first tube is suspended within the wellbore. The base is fixed against vertical movement with respect to the floor surface of the wellbore. The two or more vertical rails are attached to and they extend away from the base of the automatic slip assembly. The two or more linear actuators are attached to and they extend away from the base of the automatic slip assembly. The automatic iron roughneck is movable along the two or more vertical rails. The automatic iron roughneck includes a frame, a rotary ring, two or more die actuators, and two or more dies. The frame is attached to the one or more linear actuators. The iron roughneck is inserted within the two or more vertical rails such that the automatic iron roughneck is movable by the two or more linear actuators along a length of the two or more vertical rails, changing an elevation of the iron roughneck with respect to the automatic slip assembly and the floor surface of the wellbore. The rotary ring is disposed within the frame. The rotary ring is configured to rotate with respect to the frame. The two or more dies are disposed within a hole of the rotary ring. The two or more dies are movable by a respective one of the two or more die actuators with respect to the rotary ring toward a center of the hole of the frame. The die actuators move the dies such that, with a second tube disposed within the hole of the rotary ring and interfacing with the first tube, the two or more dies engage the second tube and the rotary ring rotates the second tube, threadedly attaching or detaching the second tube from the first tube.

In some implementations, the wellbore surface assembly also includes a controller operationally coupled to and configured to move, based on information received from sensors of the wellbore surface assembly, the two or more slip actuators, the two or more die actuators, the two or more linear actuators, and the rotary ring.

In some implementations, the base of the automatic slips assembly includes a ring-shaped base. The ring-shaped base is disposed within a hole at the surface of the wellbore such that an upper surface of the ring-shaped base is substantially flush with the surface of the wellbore.

In some implementations, the one or more vertical rails includes three or more vertical rails attached to and extending from an upper surface of the slip assembly. The three or more vertical rails are spaced equidistantly from each other and are fixed against vertical movement with respect to the wellbore surface.

In some implementations, the frame includes three or more holes spaced equidistantly from each other and each configured to receive a respective one of the one or more vertical rails. The iron roughneck is movable along the three or more vertical rails with the three or more vertical rails inserted in the three or more holes.

Implementations of the present disclosure include a tubular handling assembly that includes a slip assembly, one or more vertical rails, and an iron roughneck. The slip assembly is attached to a wellbore surface. The slip assembly includes an actuator and two or more slips defining a gap therebetween. The two or more slips are arranged to receive a first tube within the gap and secure the first tube disposed at least partially within the wellbore. The actuator moves at least one of the two or more slips, changing a width of the gap. The one or more vertical rails are fixed to the slip assembly and they extend vertically away from the slip assembly. The iron roughneck is coupled to the one or more vertical rails. The iron roughneck is movable along a length of one or more vertical rails to change a distance between the slip assembly and the iron roughneck. The iron roughneck includes a second actuator and two or more dies defining a second gap therebetween configured to receive a second tube. The second actuator moves at least one of the two or more dies such that, with the second tube interfacing with the first tube, the two or more dies engage and rotate the second tube with the iron roughneck moving toward or away from the slip assembly, threadedly attaching or detaching the second tube from the first tube.

In some implementations, the slip assembly is fixed against vertical movement with respect to the wellbore surface, such that the iron roughneck moves along the one or more vertical rails away from and with respect to the wellbore surface.

In some implementations, the slip assembly includes a ring-shaped base disposed around the two or more slips. The two or more slips are attached to and movable with respect to the ring-shaped base. The ring-shaped base is releasably attached to the surface of the wellbore.

In some implementations, the ring-shaped base is disposed within a hole at the surface of the wellbore such that an upper surface of the ring-shaped base is substantially flush with the surface of the wellbore.

In some implementations, the tubular handling assembly further includes a third actuator including a first end attached to the ring-shaped base and a second end opposite the first end attached to the iron roughneck. The third actuator includes an arm extendable and retractable to move the iron roughneck along the one or more vertical rails to change a vertical elevation of the iron roughneck with respect to the wellbore surface.

In some implementations, the two or more slips are movable toward a central axis of the ring-shaped base along a tapered annular surface of the ring-shaped base.

In some implementations, the iron roughneck includes a ring-shaped frame and a rotary ring disposed within and rotatable with respect to the ring-shaped frame. The two or more slips are disposed within and are movable with respect to the rotary ring toward a central axis of the rotary ring. The rotary ring rotates, with the slips engaged with the second tube, the second tube with respect to the first tube.

In some implementations, the ring-shaped frame includes one or more holes each configured to receive a respective one of the one or more vertical rails. The iron roughneck is movable along the one or more vertical rails with the one or more holes inserted in the one or more vertical rails.

In some implementations, the one or more vertical rails includes three or more vertical rails attached to and extending from an upper surface of the slip assembly. The three or more vertical rails are spaced an equal distance from each other and fixed against vertical movement with respect to the wellbore surface.

Implementations of the present disclosure also include a method of running tubing into a wellbore. The method includes obtaining a tubular handling assembly that includes a slip assembly, one or more vertical rails, and an iron roughneck. The slip assembly is attached to a wellbore surface. The slip assembly includes two or more slips defining a gap therebetween. The two or more slips are arranged to receive and engage a first tube within the gap disposed at least partially within the wellbore. The one or more vertical rails are fixed to the slip assembly and they extend vertically away from the slip assembly. The iron roughneck is coupled to the one or more vertical rails. The iron roughneck is movable along a length of one or more vertical rails, changing a distance between the slip assembly and the iron roughneck. The iron roughneck includes two or more dies defining a second gap therebetween configured to receive a second tube. The two or more dies are movable such that, with the second tube interfacing with the first tube, the two or more dies engage and rotate the second tube, threadedly attaching or detaching the second tube from the first tube. The method also includes engaging, by the slip assembly, the first tube disposed at least partially within the wellbore. The method also includes engaging, by the iron roughneck, the second tube. The method also includes threadedly attaching, by applying torque to the second tube by the iron roughneck, the second tube to the first tube.

In some implementations, the method further includes, before engaging the second tube, moving the iron roughneck along the at least one vertical rail, changing the distance between the iron roughneck and the slip assembly.

In some implementations, the tubular handling assembly further includes two or more linear actuators residing between and attached to the slip assembly and the iron roughneck. Moving the iron roughneck includes extending the two or more linear actuators, changing an elevation of the iron rough neck with respect to the wellbore surface.

In some implementations, moving the iron roughneck includes moving the two or more dies of the iron roughneck to an elevation of a coupling end of the second tube, and engaging the second tube includes engaging the coupling end of the second tube.

In some implementations, engaging the first tube includes engaging a coupling end of the first tube, and engaging the second tube includes engaged a coupling end of the second tube. Threadedly attaching the second tube to the first tube includes rotating the coupling end of the second tube with respect to the coupling end of the first tube.

In some implementations, engaging the first tube includes moving the two or more slips along a tapered surface of the slip assembly toward a center of the slip assembly.

DETAILED DESCRIPTION OF THE DISCLOSURE

The present disclosure describes an automated tripping tool used in tripping in and tripping out operations. The tripping tool includes a slip assembly attached to a wellbore floor surface, vertical rails extending from the slip assembly, and an iron roughneck attached to the vertical rails, above the slip assembly. The iron roughneck is slidable along the length of the vertical rails to change an elevation of the iron roughneck. The slip assembly holds a first tube hanging inside the wellbore and the iron roughneck engages and rotates a second tube to connect the second tube to the firs tube. The iron roughneck and the slip assembly can both receive tubulars of different diameters to connect tubulars of different dimensions.

Particular implementations of the subject matter described in this specification can be implemented so as to realize one or more of the following advantages. For example, the wellbore assembly of the present disclosure reduces hazard associated with manually connecting tubulars at the surface of a wellbore. Additionally, the wellbore assembly of the present disclosure can be quickly assembled and implemented in existing wellbores. The simple design of the wellbore assembly can increase the reliability of the assembly. For example, the rails extending directly from the slip assembly increases the structural integrity of the wellbore assembly. The iron roughneck is aligned with the slips by the rails, which eliminates the needs of centering the tubulars being connected.

Figure 1:
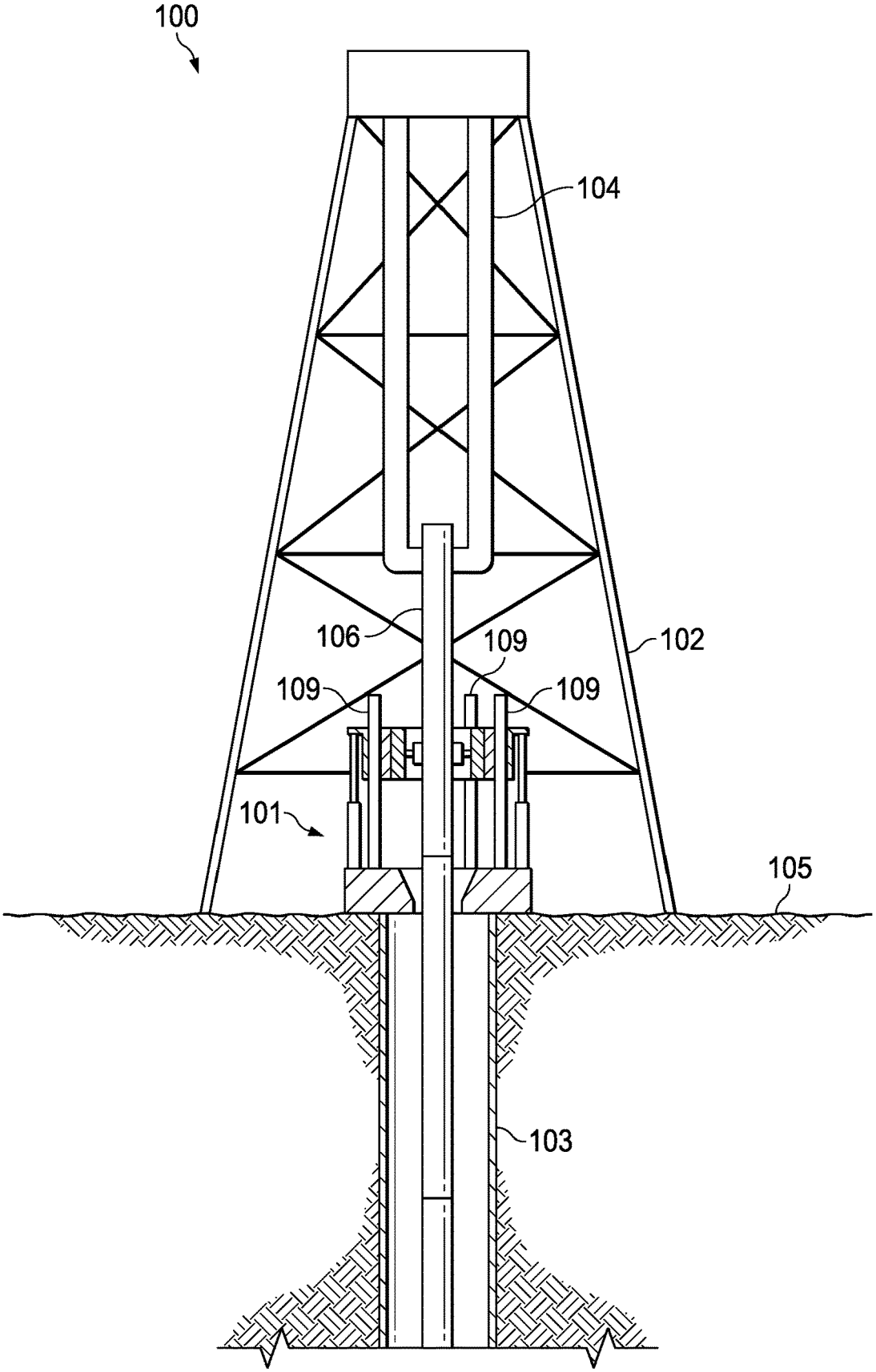
FIG. 1 is a front schematic front view, cross sectional, of a wellbore surface assembly according to implementations of the present disclosure.

FIG. 1 shows a wellbore surface assembly 100 implemented at a floor surface 105 of a wellbore 103. The wellbore surface assembly 100 includes a tubular handling assembly 101, a rig 102, and an elevator 104. The rig 102 can support and lift the elevator 104. The elevator engages and lifts tubulars 106 to be run in our out of the wellbore 103. The tubular handling assembly 101 engages the tubulars 106 lifted by the elevator 104 and connects or disconnects the tubulars 106 from each other. The elevator 104 is rotatable to allow the tubulars to be rotated by the tubular handling assembly 101.

Figure 2:
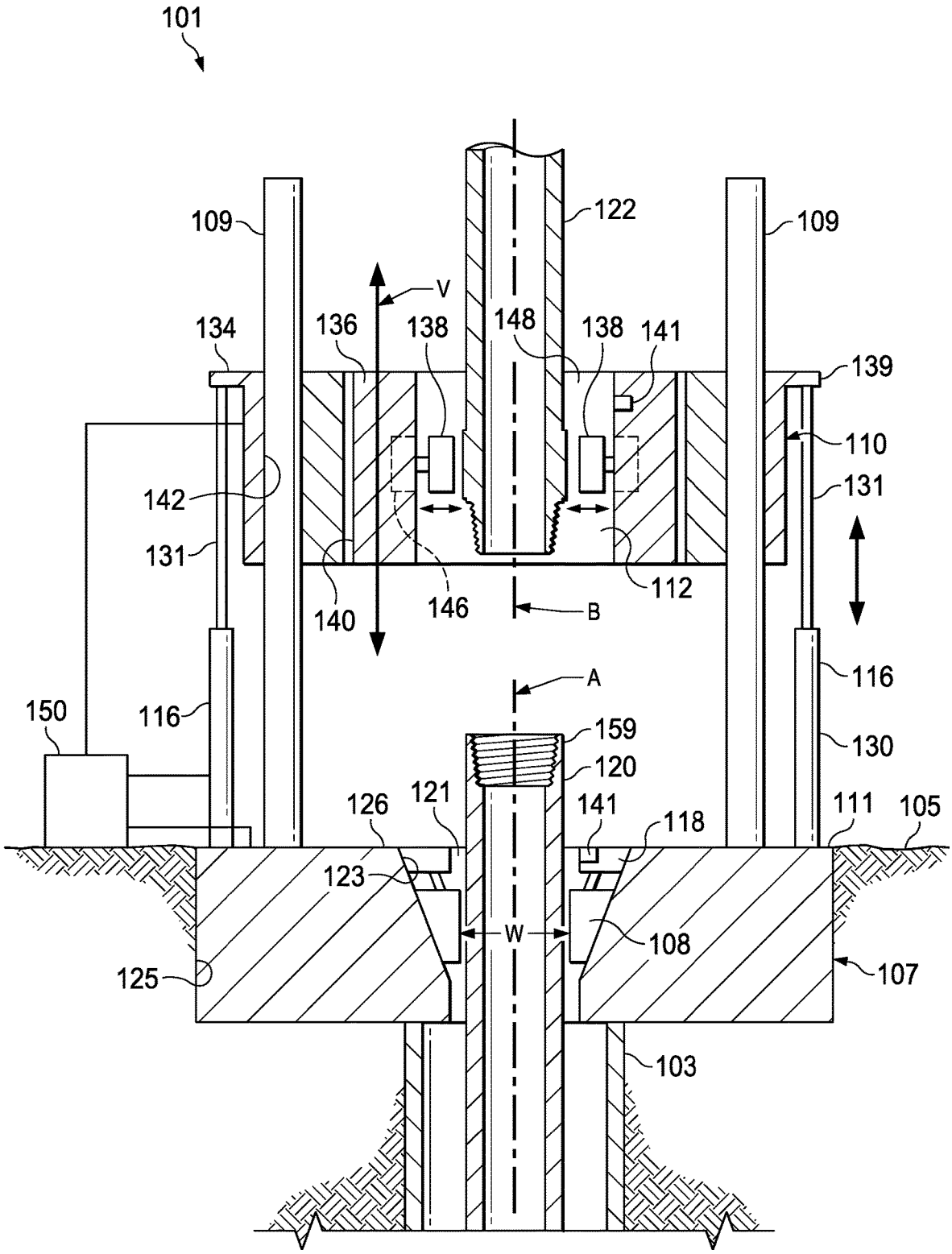
FIGS. 2-3 are front schematic views, cross sectional, of sequential steps to attach a first tube to a second tube.

As shown in FIG. 2, the tubular handling assembly 101 includes a slip assembly 107 (e.g., an automatic slip assembly), a set of rails 109, one or more linear actuators 116, and an iron roughneck 110. The wellbore assembly 101 can be an automatic assembly that requires little or no human intervention to operate. The wellbore assembly 101 can be installed on multiple types of wellbore surface 105. For example, without limitation, the slip assembly 107 can be attached to the surface of land rigs, jack-up rigs, drill-ship rigs, drilling barges, or semisubmersible rigs.

The slip assembly 107 includes a slip base 111 (e.g., a ring-shaped base) or structure, multiple slips 108 attached to the slip base 108, and multiple actuators 118. Each slip 108 can be attached to and be moved by a respective actuator 118. The slip assembly 107 can handle tubulars of multiple sizes without the need of changing the slips 108. The slips 108 are disposed inside or partially inside a hole 121 of the base 111. The slip assembly 107 can include, for example, four slips 108 spaced an equal circumferential distance from each other.

The actuators 118 can be linear actuators (e.g., hydraulic, pneumatic, roll screw, or electric actuator) move the slips 108 toward a center or central axis 'A' of the hole 121 of the base 111 to engage a first tube 120. For example, the actuators 118 extend an arm of the actuator to move the slips 108 toward the central axis 'A' of the ring-shaped base along a tapered annular surface 123 of the base 111. The slips 108 can define a gap between generally opposing slips 108. The gap has a width 'w' that changes as the slips 108 move along the tapered surface 123 to engage the first tube 120. The first tube 120 is disposed within the hole such that the first tube 120 is suspended within the wellbore 103.

The base 111 of the slip assembly 107 is fixed against vertical movement 'V' with respect to the floor surface 105 of the wellbore 103. For example, the base 111 can be releasably attached to the surface 105 such that the slip assembly 107 can be removed for maintenance purposes, but remains otherwise secured to the surface 105 during operation. The base 111 can be disposed above the surface (as shown in FIG. 1), or can be disposed within a hole 125 extending from the surface 105 of the wellbore 103. For example, with the base 111 residing inside the surface hole 125, an upper surface 126 of the ring-shaped base 111 can be substantially flush with the surface 105 of the wellbore 103.

The tubular handling assembly 101 includes one or more vertical rails 109. For example, the tubular handling assembly 101 can have two opposing rails 109 or three rails spaced an equal distance from each other, as shown in FIG. 1. The vertical rails 109 are attached to and extend away from the base 111 of the slip assembly 107. The rails can be fixed to the base 111 such that the rails 109 do not move with respect to the base 111 and by extension with respect to the floor surface 105. The rails can be, for example, in the form of circular rods, or I-beams or H-beams or another similar configuration. The rails 109 are fixed against vertical movement with respect to the wellbore surface 105.

The tubular handling assembly 101 has one or more actuators 116 attached to and extend away from the base 111 of the automatic slip assembly 107. The actuators 116 can be linear actuators (e.g., hydraulic, pneumatic, roll screw, or electric actuators). For example, the linear actuators 116 can include a cylinder 130 attached to the base 111 of the slip assembly 107 and an arm 131 attached to the iron roughneck 110. To move the iron roughneck 110. The arm 131 extends from or retracts into the cylinder 130.

The iron roughneck 110 (e.g., automatic iron roughneck) is inserted into and movable along the vertical rails 109. The iron roughneck 110 has a frame 134, a rotary or rotatable ring 136, and dies or jaws 138 that grip a second tube 122.

The frame 134 can be a ring-shaped frame with an aperture to receive the annular ring 136. The frame 134 is attached to the actuators 116. For example, the frame can have a shoulder 139 that is attached to an end of each actuator 116. The frame 134 has apertures 142 that each receives a respective rail 109 so that the frame 134 is inserted into the vertical rails 109. For example, the apertures 142 can be arranged equidistantly from each other to receive the trails 109 that are equidistantly spaced from each other. The actuators 116 move the frame 134 along the length of the two or more vertical rails 109 as the actuators 116 expand or contract. Thus, the actuators 116 move the iron roughneck 139 along the vertical direction 'V' to change an elevation of the iron roughneck 110 with respect to the automatic slip assembly 107 and the floor surface 105 of the wellbore 103. In some implementations, the rails 109 can be screw rails, the holes 142 be threaded holes that thread into the rails 109, and the actuators 119 can rotate the screw rails to move the iron roughneck 110 up and down.

The rotary ring 136 is disposed within the frame 134. The rotary ring 136 rotates with respect to the frame 134. For example, the iron roughneck includes bearings 140 disposed between the frame 134 and the rotary ring 136 to allow rotation of rotary ring 136. The rotary ring 136 can be rotated by, for example, a mechanical or electrical mechanism. For example, the rotary ring 136 can have teeth (e.g., teeth around its circumference or on a top or bottom surface or the ring 136), and a pneumatically or hydraulically operated motor with a pinion can engage the teeth and rotate the rotary ring 136.

Figure 3:
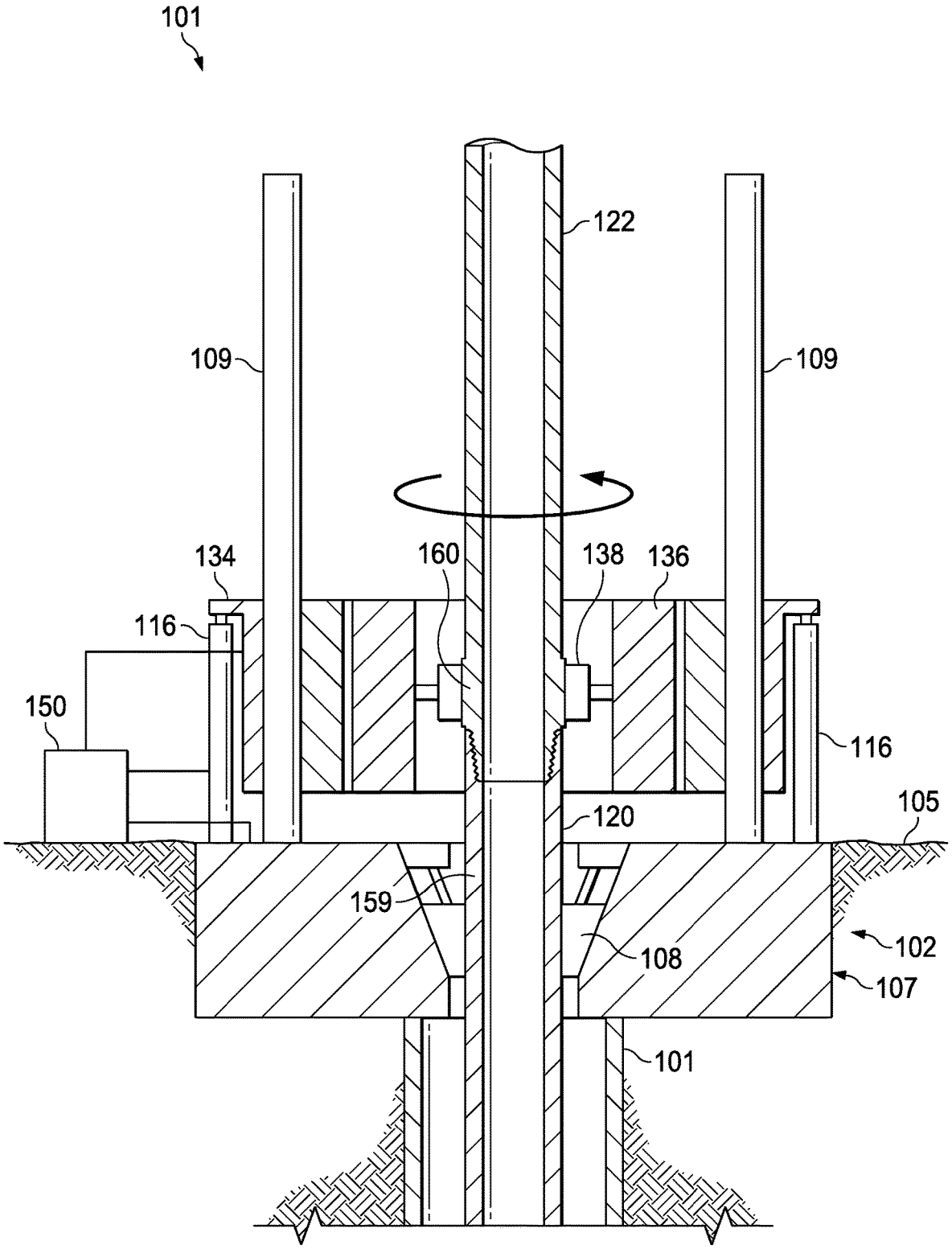

The iron roughneck 110 has actuators 146 and dies or jaws 138 each attached to and a respective actuator 146. The dies 138 are disposed inside a hole 148 of the rotary ring 136. The die actuators 146 can be partially disposed inside the rotary ring 136. The die actuators 146 extend to move the dies 139 toward a central axis 'B' of the hole 146 or of the rotary ring 136. As shown in FIG. 3, the dies 138 engage the second tube 122 such that, with the second tube 122 disposed within the hole 148 of the rotary ring 136 and interfacing with the first tube 120, the dies 138 engage the second tube 122 and the rotary ring 136 rotates the second tube 122, threadedly attaching or detaching the second tube 122 from the first tube 120.

The tubular handling assembly 101 can also include a controller 150 operationally coupled to the slip actuators 118, the die actuators 146, the iron roughneck actuators 116, and the rotary ring 136. The controller 150 can move these components based on instructions received from sensors 141 of the slip assembly, iron roughneck, and actuators. The controller 150 can also control the components based on operator inputs or a combination of operator inputs and sensor information. The sensors 141 can include, without limitation, optical sensors, proximity sensors, or motion sensors.

The sensors 141 are communicatively coupled to the controller 150 which has a memory storing instructions that, when executed, cause the controller 150 to move, based on the information received from the sensors 141, the jaws 138 and rotary ring 136 of the iron roughneck 110, the slips 108 (or the actuators 118) of the slip assembly 107, and the linear actuators 131 that move the iron roughneck 110. For example, the sensors 141 of the iron roughneck 110 can sense the presence of the second tubular 122 inside the iron roughneck 110 and the controller can, based on the sensed information, actuate the jaws 138 to engage the tubular 122. The controller 150 can similarly move the slips 108, the ring 136, and the actuators 116 based on sensor information that indicates that the respective tubular 122 or 120 is in a predetermined position.

In some implementations, a human operator can perform some functions of the process of attaching and dethatching the tubulars, such as raising or lowering the iron roughneck 110, or align the second tubular 122 to be inserted into the iron roughneck 110.

In some implementations, the rails 109 are the only sets of rails in the tubular handling assembly 101 and are only to move the iron roughneck 110 with respect to the wellbore surface 105. In some implementations, the slips 108 are the only set of slips used to hold the first tube 120.

To attach the first tube 120 to the second tube 122, the elevator 104 can first insert the first tube 120 into the wellbore 103. With the elevator holding the tube 120, the slips move inwardly to engage a coupling end 159 of the first tube 120. The elevator 104 disengages the first tube 120 and engages the second tube 122 from a loading station. The elevator 104 lifts the second tube above the tubular handling assembly 101, and inserts the second tube 122 into the hole 148 of the iron roughneck 110. The iron roughneck 110 can move along the rails 109 to position the dies 138 about a coupling end 160 of the second tube. As shown in FIG. 3, with the coupling end 160 of the second tube supported on the coupling end 159 of the first tube 120, the dies 138 engage the coupling end 160 and the rotary ring 136 rotates to rotate the dies 138 and thus rotate the second tube 122 with respect to the first tube 120. Rotating the second tube 122 with respect to the first tube 122 threadedly attaches the second tube 122 into the first tube 120.

Figure 4:
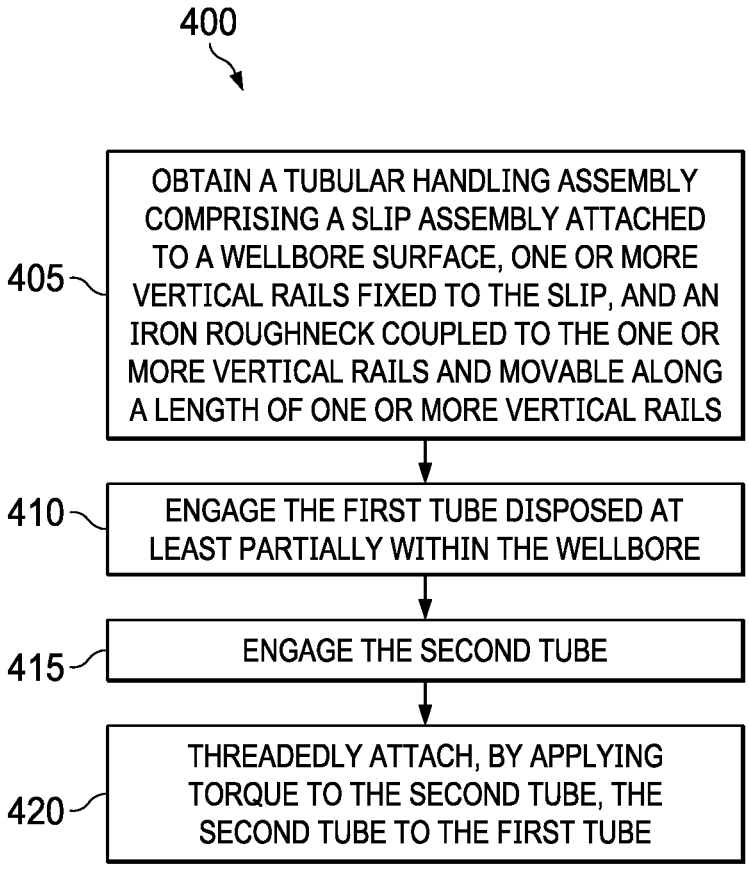
FIG. 4 is a flow chart of an example method of running tubing within a wellbore.

FIG. 4 shows a flow chart of an example method (400) of running a piping assembly into a wellbore. The method includes obtaining a tubular handling assembly comprising a slip assembly attached to a wellbore surface, one or more vertical rails fixed to the slip, and an iron roughneck coupled to the one or more vertical rails and movable along a length of one or more vertical rails (405). The method also includes engaging, by the slip assembly, the first tube disposed at least partially within the wellbore (410). The method also includes engaging, by the iron roughneck, the second tube (415). The method also includes threadedly attaching, by applying torque to the second tube by the iron roughneck, the second tube to the first tube (420).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A wellbore surface assembly comprising:

an automatic slip assembly attached to a floor surface of a wellbore, the automatic slip assembly comprising, a base releasably attached to a rig floor, the base configured to be releasably attached to and removed from different rig floors, two or more slip actuators, and two or more floor slips disposed within a hole of the base, each of the two or more slips movable by a respective one of the two or more slip actuators toward a center of the hole of the base, engaging a first tube disposed within the hole such that the first tube is suspended within the wellbore, the base fixed against vertical movement with respect to the floor surface of the wellbore;

two or more vertical rails mounted directly to and extending away from the base of the automatic slip assembly, the base fixed against movement with respect to the vertical rails;

two or more linear actuators mounted directly to and extending away from the base of the automatic slip assembly; and an automatic iron roughneck movable along the two or more vertical rails, the automatic iron roughneck comprising, a frame attached to the one or more linear actuators and inserted within the two or more vertical rails such that the automatic iron roughneck is movable by the two or more linear actuators along a length of the two or more vertical rails, changing an elevation of the iron roughneck with respect to the automatic slip assembly and the floor surface of the wellbore, a rotary ring disposed within the frame, the rotary ring configured to rotate with respect to the frame, two or more die actuators, and two or more dies disposed within a hole of the rotary ring, the two or more dies movable by a respective one of the two or more die actuators with respect to the rotary ring toward a center of the hole of the frame such that, with a second tube disposed within the hole of the rotary ring and interfacing with the first tube, the two or more dies engage the second tube and the rotary ring rotates the second tube, threadedly attaching or detaching the second tube from the first tube, wherein the rails are mounted directly to the base and the frame is attached to the rails such that the hole of the rotary ring is aligned with the hole of the base with the base attached to and detached from the rig floor.

2. The wellbore surface assembly of claim 1, further comprising a controller operationally coupled to and configured to move, based on information received from sensors of the wellbore surface assembly, the two or more slip actuators, the two or more die actuators, the two or more linear actuators, and the rotary ring.

3. The wellbore surface assembly of claim 2, wherein the base of the automatic slips assembly comprises a ring-shaped base, the ring-shaped base disposed within a hole at the surface of the wellbore such that an upper surface of the ring-shaped base is substantially flush with the surface of the wellbore.

4. The wellbore surface assembly of claim 2, wherein the two or more vertical rails comprises three vertical rails attached to and extending from an upper surface of the slip assembly, the three vertical rails spaced equidistantly from each other and fixed against vertical movement with respect to the wellbore surface.

5. The wellbore surface assembly of claim 4, wherein the frame comprises three holes spaced equidistantly from each other and each of the three holes is configured to receive a respective one of the three vertical rails to allow the iron roughneck to move along the three vertical rails.

6. A tubular handling assembly comprising:

a slip assembly releasably attached to a wellbore surface, the slip assembly comprising a base configured to be releasably attached to and removed from different rig floors, an actuator coupled to the base, and two or more floor slips defining a gap therebetween, the two or more slips arranged to receive a first tube within the gap and secure the first tube disposed at least partially within the wellbore, the actuator configured to move at least one of the two or more slips, changing a width of the gap;

one or more vertical rails mounted directly to the base of the slip assembly and extending vertically away from the slip assembly, the base fixed against movement with respect to the vertical rails; and an iron roughneck coupled to the one or more vertical rails, the iron roughneck movable along a length of one or more vertical rails, changing a distance between the slip assembly and the iron roughneck, the iron roughneck comprising a second actuator and two or more dies defining a second gap therebetween configured to receive a second tube, the second actuator configured to move at least one of the two or more dies such that, with the second tube interfacing with the first tube, the two or more dies engage and rotate the second tube with the iron roughneck moving toward or away from the slip assembly, threadedly attaching or detaching the second tube from the first tube, wherein the rails are mounted directly to the base and the iron roughneck is attached to the rails such that the second gap of the iron roughneck is aligned with the gap of the slip assembly with the base attached a rig floor and with the base detached from the rig floor.

7. The tubular handling assembly of claim 6, wherein the slip assembly is fixed against vertical movement with respect to the wellbore surface, such that the iron roughneck moves along the one or more vertical rails away from and with respect to the wellbore surface.

8. The tubular handling assembly of claim 7, wherein the slip assembly comprises a ring-shaped base disposed around the two or more slips, the two or more slips attached to and movable with respect to the ring-shaped base.

9. The tubular handling assembly of claim 8, wherein the ring-shaped base is disposed within a hole at the surface of the wellbore such that an upper surface of the ring-shaped base is substantially flush with the surface of the wellbore.

10. The tubular handling assembly of claim 8, further comprising a third actuator comprising a first end attached to the ring-shaped base and a second end opposite the first end attached to the iron roughneck, the third actuator comprising an arm extendable and retractable to move the iron roughneck along the one or more vertical rails to change a vertical elevation of the iron roughneck with respect to the wellbore surface.

11. The tubular handling assembly of claim 7, wherein the two or more slips are movable toward a central axis of the ring-shaped base along a tapered annular surface of the ring-shaped base.

12. The tubular handling assembly of claim 6, wherein the iron roughneck comprises a ring-shaped frame and a rotary ring disposed within and rotatable with respect to the ring-shaped frame, the two or more slips disposed within and movable with respect to the rotary ring toward a central axis of the rotary ring, the rotary ring configured to rotate, with the slips engaged with the second tube, the second tube with respect to the first tube.

13. The tubular handling assembly of claim 12, wherein the ring-shaped frame comprises one or more holes each configured to receive a respective one of the one or more vertical rails, the iron roughneck movable along the one or more vertical rails with the one or more holes inserted in the one or more vertical rails.

14. The tubular handling assembly of claim 13, wherein the one or more vertical rails comprises three or more vertical rails attached to and extending from an upper surface of the slip assembly, the three or more vertical rails spaced an equal distance from each other and fixed against vertical movement with respect to the wellbore surface.

15. A method of running tubing into a wellbore, the method comprising:

obtaining a tubular handling assembly comprising:

a slip assembly configured to be releasably attached to a wellbore surface, the slip assembly comprising a base configured to be releasably attached to and removed from different rig flours, and two or more floor slips defining a gap therebetween, the two or more slips arranged to receive and engage a first tube within the gap disposed at least partially within the wellbore, one or more vertical rails mounted directly to the base of the slip assembly and extending vertically away from the slip assembly, the base fixed against movement with respect to the vertical rails; and an iron roughneck coupled to the one or more vertical rails, the iron roughneck movable along a length of one or more vertical rails, changing a distance between the slip assembly and the iron roughneck, the iron roughneck comprising two or more dies defining a second gap therebetween configured to receive a second tube, the two or more dies movable such that, with the second tube interfacing with the first tube, the two or more dies engage and rotate the second tube, threadedly attaching or detaching the second tube from the first tube, wherein the rails are directly mounted to the base, the iron roughneck being attached to the rails such that the second gap of the iron roughneck is aligned with the gap of the slip assembly with the base attached to a rig floor and with the base detached from the rig floor;

installing the tubular handling assembly on a rig floor;

engaging, by the slip assembly, the first tube disposed at least partially within the wellbore;

engaging, by the iron roughneck, the second tube, and threadedly attaching, by applying torque to the second tube by the iron roughneck, the second tube to the first tube.

16. The method of claim 15, further comprising, before engaging the second tube, moving the iron roughneck along the at least one vertical rail, changing the distance between the iron roughneck and the slip assembly.

17. The method of claim 16, wherein the tubular handling assembly further comprises two or more linear actuators residing between and attached to the slip assembly and the iron roughneck, and moving the iron roughneck comprises extending the two or more linear actuators, changing an elevation of the iron rough neck with respect to the wellbore surface.

18. The method of claim 17, wherein moving the iron roughneck comprises moving the two or more dies of the iron roughneck to an elevation of a coupling end of the second tube, and engaging the second tube comprises engaging the coupling end of the second tube.

19. The method of claim 15, wherein engaging the first tube comprises engaging a coupling end of the first tube, and engaging the second tube comprises engaged a coupling end of the second tube, and threadedly attaching the second tube to the first tube comprises rotating the coupling end of the second tube with respect to the coupling end of the first tube.

20. The method of claim 15, wherein engaging the first tube comprises moving the two or more slips along a tapered surface of the slip assembly toward a center of the slip assembly.

* * * * *